US011320201B2

(12) United States Patent
Uemura et al.

(10) Patent No.: US 11,320,201 B2
(45) Date of Patent: May 3, 2022

(54) WEB DRYING APPARATUS AND WEB DRYING METHOD

(71) Applicant: SCREEN HOLDINGS CO., LTD., Kyoto (JP)

(72) Inventors: Ryota Uemura, Kyoto (JP); Keisuke Hirai, Kyoto (JP); Yoshikuni Takeichi, Kyoto (JP); Takeshi Matsuda, Kyoto (JP); Kenta Hiramatsu, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 140 days.

(21) Appl. No.: 16/805,287

(22) Filed: Feb. 28, 2020

(65) Prior Publication Data

US 2020/0292232 A1 Sep. 17, 2020

(30) Foreign Application Priority Data

Mar. 13, 2019 (JP) ..... JP2019-045605

(51) Int. Cl.
*F26B 13/00* (2006.01)
*F26B 13/10* (2006.01)
*F26B 21/00* (2006.01)

(52) U.S. Cl.
CPC ..... *F26B 13/108* (2013.01); *F26B 21/001* (2013.01); *F26B 21/004* (2013.01)

(58) Field of Classification Search
CPC ..... F26B 13/108; F26B 13/10; F26B 13/28; F26B 13/06; F26B 21/001; F26B 21/004; F26B 25/08; B65H 20/10
(Continued)

(56) References Cited

U.S. PATENT DOCUMENTS 1,737,015 A * 11/1929 Merrill ..... F26B 13/104 34/643
4,575,952 A 3/1986 Bodenan et al.
(Continued)

FOREIGN PATENT DOCUMENTS

EP 1 455 153 A2 9/2004
JP 2000-024574 A 1/2000
KR 10-2012-0113180 A 10/2012

OTHER PUBLICATIONS

Extended European Search Report issued in corresponding European Patent Application No. 20159113.8-1009, dated Aug. 28, 2020.
(Continued)

*Primary Examiner* — John P Mccormack
(74) *Attorney, Agent, or Firm* — McDermott Will & Emery LLP

(57) ABSTRACT

A web drying apparatus, comprises: a blow-drying part which has two blower units arranged on both sides of web which is transferred in a transfer direction, and injects gas onto the web passing through a dry path between the two blower units; a housing which has a sidewall provided with an opening facing the dry path from the transfer direction, through which the web passes in the transfer direction through the opening, and houses the blow-drying part; an exhaust part which is disposed between the sidewall and the blow-drying part in the housing and exhausts gas from the inside of the housing to the outside of the housing; and a rectifying member which is disposed between the blow-drying part and the exhaust part in the housing and faces the web being transferred in the transfer direction.

10 Claims, 5 Drawing Sheets

(58) Field of Classification Search
USPC ..... 34/643, 64, 541, 585, 638, 201
See application file for complete search history.

(56) References Cited

U.S. PATENT DOCUMENTS

| | | | | | |
|---|---|---|---|---|---|
| 4,785,986 | A * | 11/1988 | Daane | F26B 13/104 | 242/615.11 |
| 5,564,200 | A * | 10/1996 | Strahm | D06C 3/02 | 34/635 |
| 9,228,780 | B2 * | 1/2016 | McMahon | F26B 3/32 | |
| 2003/0145481 | A1 | 8/2003 | Zagar et al. | | |
| 2007/0227034 | A1 * | 10/2007 | Ogawa | F26B 21/004 | 34/444 |
| 2015/0255780 | A1 | 9/2015 | Tsuchiya | | |

OTHER PUBLICATIONS

Korean Notification of Reasons for Refusal issued in corresponding Korean Patent Application No. 10-2020-0003199, dated Jun. 10, 2021, with English translation.

* cited by examiner

WEB DRYING APPARATUS AND WEB DRYING METHOD

CROSS REFERENCE TO RELATED APPLICATION

The disclosure of Japanese Patent Application No. 2019-045605 filed on Mar. 13, 2019 including specification, drawings and claims is incorporated herein by reference in its entirety.

BACKGROUND OF THE INVENTION

1. Field of the Invention

The present invention relates to a technology for drying web by injecting gas onto the web while transferring the web in a transfer direction.

2. Description of the Related Art

Conventionally, a web drying apparatus for drying web by injecting gas onto the web from a blow-drying part has been well known. In a web drying apparatus (drying furnace) disclosed in Japanese Patent Application Laid Open Gazette No. 2000-24574, for example, a blow-drying part provided with two air floating dryers dries web. This web drying apparatus includes the two air floating dryers disposed on both sides (upper and lower sides) of the web being transferred in a transfer direction, and each of the air floating dryers injects air onto the web passing through a dry path between these air floating dryers.

Further, the web drying apparatus includes a housing which houses these air floating dryers. Both sidewalls of the housing are provided with openings facing the dry path from the transfer direction, respectively. The openings serve as a loading port and an unloading port for the web, respectively, and the web to be loaded and unloaded into/from the housing passes through the sidewall through the opening.

SUMMARY OF THE INVENTION

In such a web drying apparatus, in order to suppress retention of gas inside the housing, it is considered to provide an exhaust part for exhausting gas from the housing, between the blow-drying part and the opening. Since the exhaust of gas is performed by the exhaust part additionally to the injection of gas performed by the blow-drying part, however, there are cases where airflow is disturbed in an area between the blow-drying part and the exhaust part and the web flutters in the vicinity of the opening of the housing.

The present invention is intended to solve the above problem, and it is an object of the present invention to make it possible to suppress flutter of web in the vicinity of an opening due to an effect of exhaust by an exhaust part provided between a blow-drying part and an opening of a housing while drying the web by injection of gas from the blow-drying part.

A web drying apparatus according to the invention, comprises: a blow-drying part which has two blower units arranged on both sides of web which is transferred in a transfer direction, and injects gas onto the web passing through a dry path between the two blower units; a housing which has a sidewall provided with an opening facing the dry path from the transfer direction, through which the web passes in the transfer direction through the opening, and houses the blow-drying part; an exhaust part which is disposed between the sidewall and the blow-drying part in the housing and exhausts gas from the inside of the housing to the outside of the housing; and a rectifying member which is disposed between the blow-drying part and the exhaust part in the housing and faces the web being transferred in the transfer direction.

A web drying method according to the invention, comprises: transferring a web in a transfer direction; injecting gas from two blower units included in a blow-drying part onto the web passing through a dry path between the two blower units; and exhausting gas from the inside to the outside of a housing which has a sidewall provided with an opening facing the dry path from the transfer direction, through which the web passes in the transfer direction through the opening, and houses the blow-drying part, by an exhaust part disposed between the sidewall and the blow-drying part in the housing, wherein a rectifying member disposed between the blow-drying part and the exhaust part in the housing faces the web being transferred in the transfer direction.

In the present invention (the web drying apparatus, the web drying method) having such a configuration, the rectifying member disposed between the blow-drying part and the exhaust part in the housing faces the web being transferred in the transfer direction. Therefore, it is possible to suppress disturbance of airflow in an area between the blow-drying part and the exhaust part by the rectifying member. As a result, it is possible to suppress flutter of the web in the vicinity of the opening due to an effect of exhaust by the exhaust part provided between the blow-drying part and the opening of the housing.

Thus, according to the present invention, it is possible to suppress the flutter of the web in the vicinity of the opening due to an effect of exhaust by the exhaust part provided between the blow-drying part and the opening of the housing while drying the web by injection of gas from the blow-drying part.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
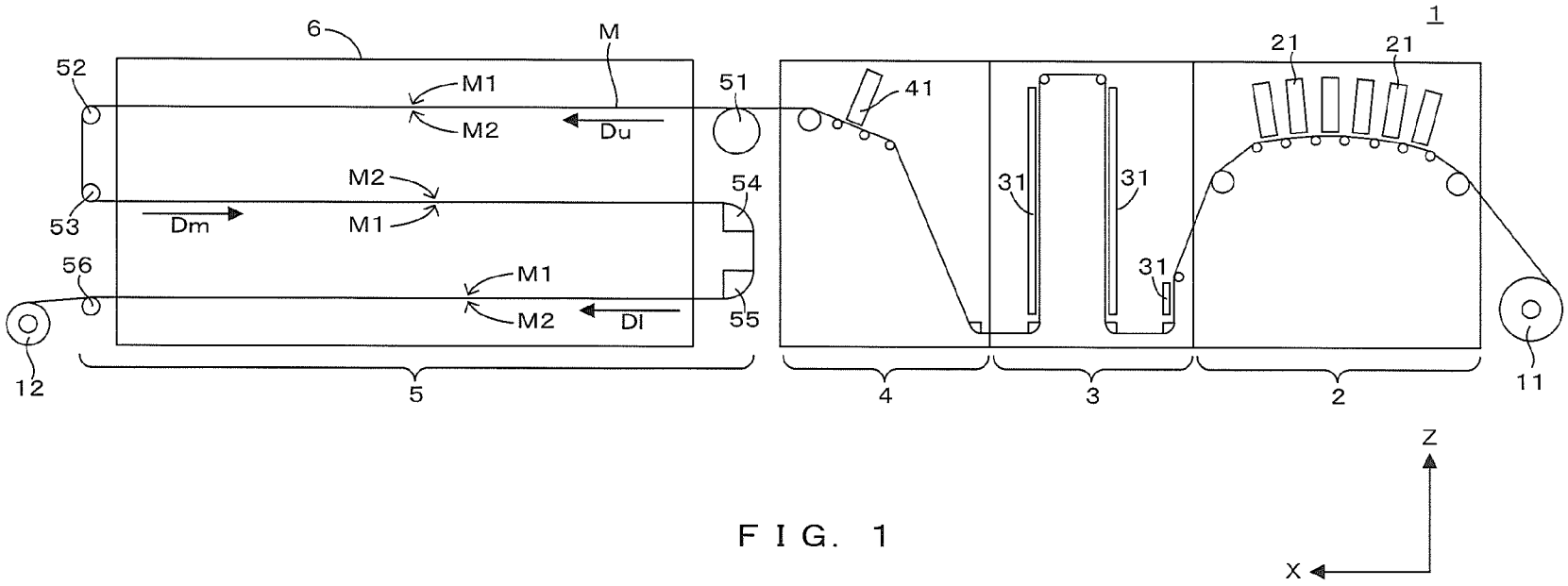
FIG. 1 is an elevational view schematically showing one example of a printing system including a drying furnace which corresponds to one example of a web drying apparatus in accordance with the present invention.

FIG. 1 is an elevational view schematically showing one example of a printing system including a drying furnace which corresponds to one example of a web drying apparatus in accordance with the present invention. In FIG. 1 and the following figures, a horizontal direction X and a vertical direction Z are shown as appropriate. As shown in FIG. 1, a printing system 1 includes a configuration in which a prestage printer 2, a prestage drying furnace 3, a post-stage printer 4, and a post-stage drying furnace 5 which have the same height are arranged in this order in the horizontal direction X (arrangement direction). This printing system 1 transfers a printing medium M from a feed roll 11 to a wind-up roll 12 in a roll-to-roll process while causing the prestage drying furnace 3 to dry the printing medium M printed by the prestage printer 2 and further causing the post-stage drying furnace 5 to dry the printing medium M printed by the post-stage printer 4. Further, as the printing medium M, various materials such as paper, a film, or the like can be used. Furthermore, hereinafter, among both surfaces of the printing medium M, the surface on which an image is printed is referred to as a front surface M1 and the other surface opposite to the front surface M1 is referred to as a back surface M2 as appropriate.

The prestage printer 2 includes a plurality of print heads 21 which eject ink by the inkjet method onto the front surface M1 of the printing medium M. In the exemplary case shown herein, provided are six print heads 21 including four print heads 21 which eject inks of four process colors (yellow, magenta, cyan, and black) and two print heads 21 which eject inks of two special colors (orange, violet, green, or the like). Specifically, the prestage printer 2 can print a color image on the front surface M1 of the printing medium M by using the six print heads 21 which eject color inks of different colors from one another. Further, the print heads 21 which eject the special color inks are not indispensable.

The printing medium M on which the color image is printed by the prestage printer 2 is transferred from the prestage printer 2 to the prestage drying furnace 3. The prestage drying furnace 3 uses a heater 31 to heat the printing medium M while folding the printing medium M over in the vertical direction Z as appropriate. The ink adhered on the front surface M1 of the printing medium M is thereby dried. The means to dry the printing medium M in the prestage drying furnace 3 is not limited to the heater 31, but the printing medium M may be heated and dried by injecting hot air, or may be dried by injecting gas of room temperature.

Thus, the printing medium M dried by the prestage drying furnace 3 is transferred from the prestage drying furnace 3 to the post-stage printer 4. The post-stage printer 4 includes a print head 41 for ejecting ink by the inkjet method onto the front surface M1 of the printing medium M. In the exemplary case shown herein, the print head 41 ejects white ink. Therefore, the post-stage printer 4 can print a white background image on the front surface M1 of the printing medium M, to the color image printed by the prestage printer 2.

The printing medium M on which the background image is printed by the post-stage printer 4 is transferred from the post-stage printer 4 to the post-stage drying furnace 5. Then, the post-stage drying furnace 5 dries the inks forming the color image printed on the printing medium M by the prestage printer 2 and the ink forming the background image printed on the printing medium M by the post-stage printer 4.

Figure 2:
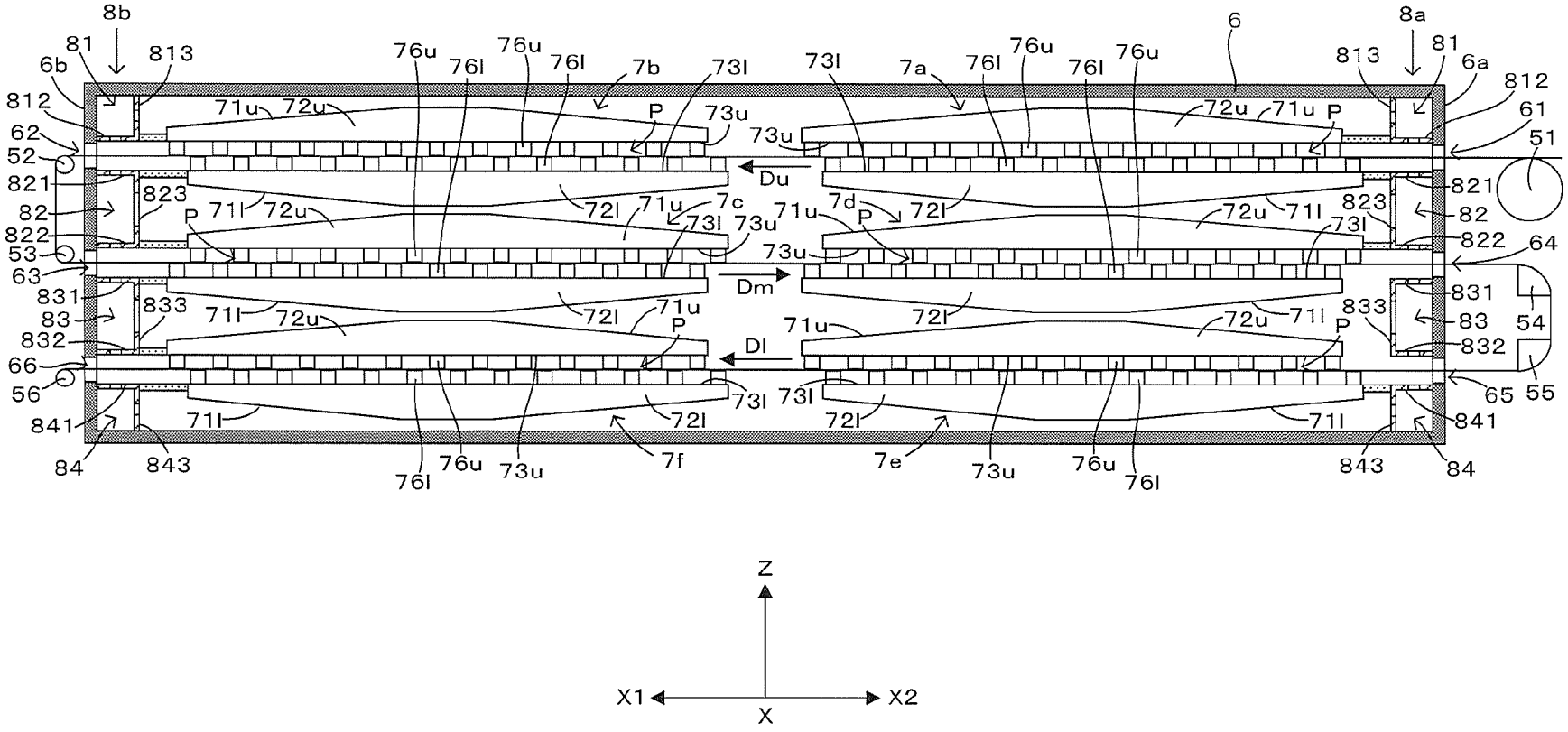
FIG. 2 is a partial cross section of an elevational view schematically showing a post-stage drying furnace included in the printing system of FIG. 1.
Figure 3:
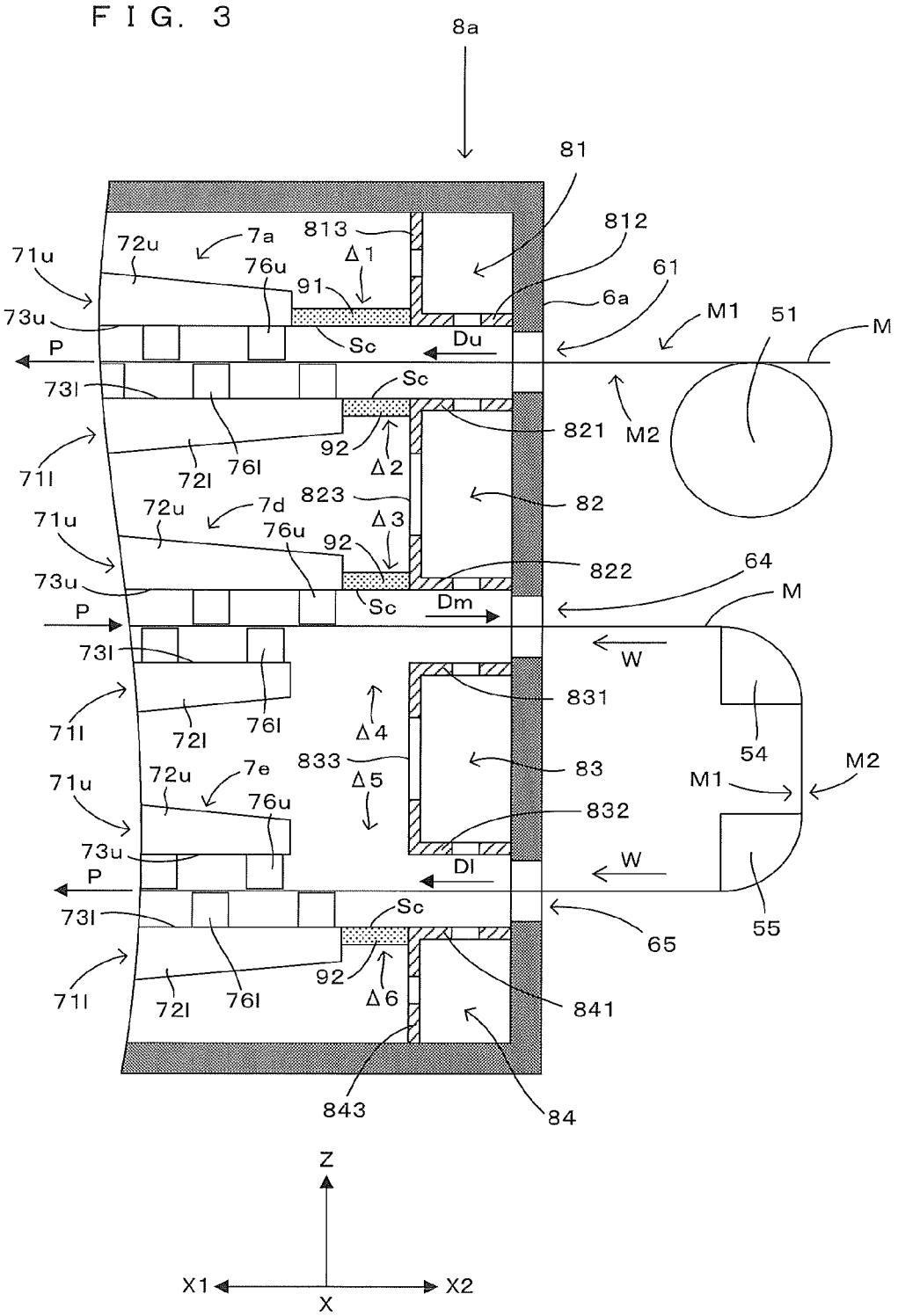
FIG. 3 is a partial cross section of an elevational view schematically showing an end portion of the post-stage drying furnace of FIG. 2 on a post-stage printer side.
Figure 4:
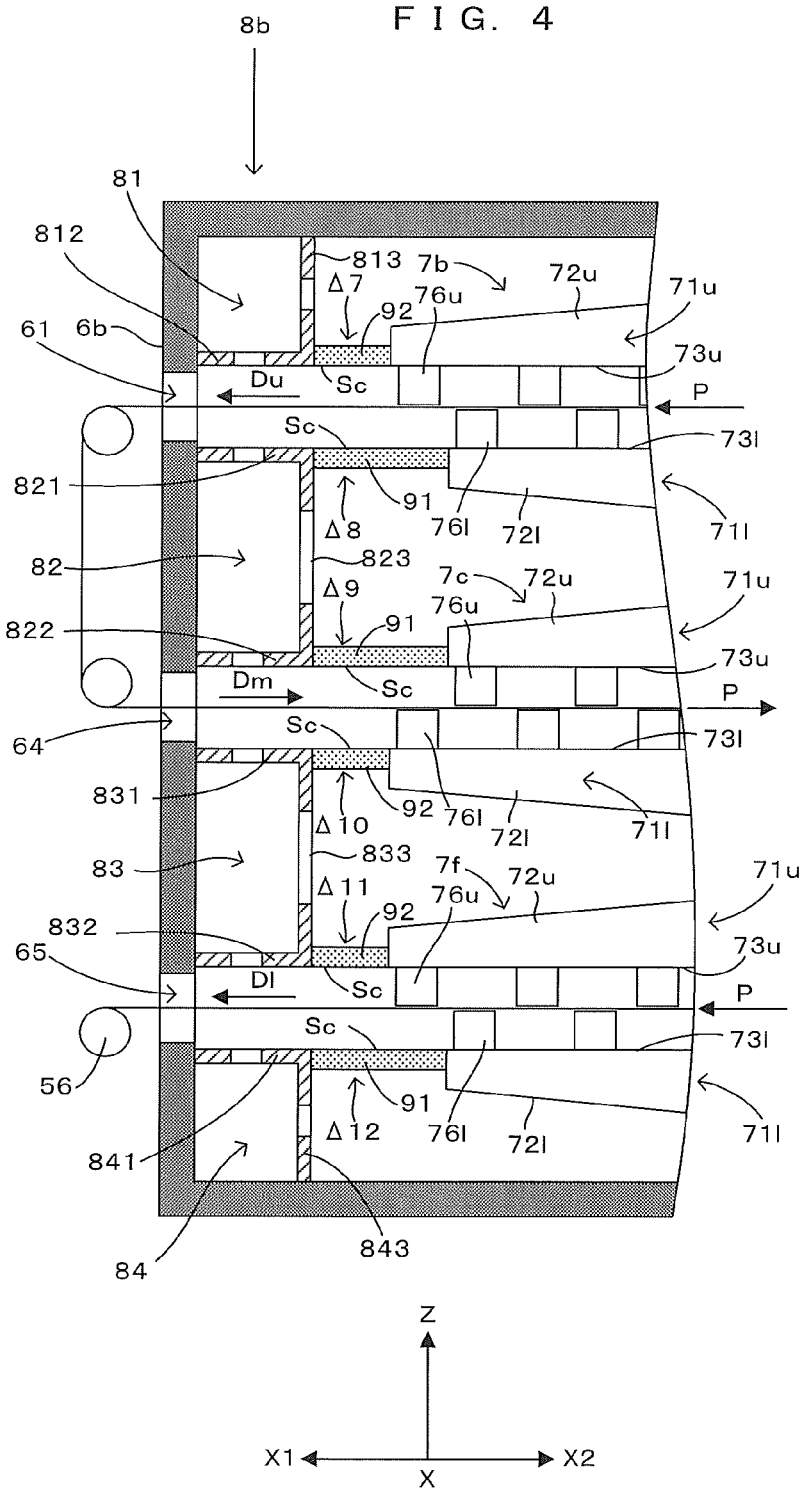
FIG. 4 is a partial cross section of an elevational view schematically showing an end portion of the post-stage drying furnace of FIG. 2 on the opposite side to the post-stage printer.

FIG. 2 is a partial cross section of an elevational view schematically showing a post-stage drying furnace included in the printing system of FIG. 1, FIG. 3 is a partial cross section of an elevational view schematically showing an end portion of the post-stage drying furnace of FIG. 2 on a post-stage printer side, and FIG. 4 is a partial cross section of an elevational view schematically showing an end portion of the post-stage drying furnace of FIG. 2 on the opposite side to the post-stage printer. In FIGS. 2 to 4, one side of the horizontal direction X is represented as an "X1 side", and the other side of the horizontal direction X is represented as an "X2 side" (the opposite side to the X1 side). Further, also in the following figures, like representation will be used as appropriate.

The post-stage drying furnace 5 dries the printing medium M while folding the printing medium M over in the horizontal direction X as appropriate and transferring it. This post-stage drying furnace 5 includes a housing 6 disposed with an interval from the post-stage printer 4 in the horizontal direction X. This housing 6 has a rectangular parallelepiped shape extending in the horizontal direction X, and both sidewalls 6*a* and 6*b* of the housing 6 in the horizontal direction X are in parallel with the vertical direction Z and perpendicular to the horizontal direction X, facing each other with an interval in the horizontal direction X.

In the sidewall 6*a* on the X2 side (on the post-stage printer 4 side) in the horizontal direction X out of the sidewalls 6*a* and 6*b*, three openings 61, 64, and 65 aligned in the vertical direction Z penetrate in the horizontal direction X, and in the sidewall 6*b* on the X1 side (on the opposite side to the post-stage printer 4) in the horizontal direction X, three openings 62, 63, and 66 aligned in the vertical direction Z penetrate in the horizontal direction X. In the sidewall 6*a*, the opening 61 is provided upper than the opening 64, and the opening 64 is provided upper than the opening 65. In the sidewall 6*b*, the opening 62 is provided upper than the opening 63, and the opening 63 is provided upper than the opening 66. The openings 61 and 62 are positioned at the same height, facing each other in the horizontal direction X, the openings 63 and 64 are positioned at the same height, facing each other in the horizontal direction X, and the openings 65 and 66 are positioned at the same height, facing each other in the horizontal direction X. Then, the printing medium M passes through these openings 61 to 66 sequentially to move between the inside and the outside of the housing 6 while being transferred by the feed roll 11 and the wind-up roll 12.

The post-stage drying furnace 5 includes a roller 51 disposed outside the housing 6 with respect to the opening 61. The roller 51 is disposed on the X2 side to the housing 6 in the horizontal direction X (in other words, disposed between the post-stage printer 4 and the housing 6), and supports the printing medium M from the back surface M2 side by coming into contact with the back surface M2 (lower surface) of the printing medium M. Then, the printing medium M unloaded from the post-stage printer 4 is loaded into the housing 6 through the opening 61 of the sidewall 6*a* while being supported by the roller 51. Thus, the printing medium M passing through the sidewall 6*a* through the opening 61 is moved in an upper-stage transfer direction Du directed from the opening 61 to the opening 62 in parallel with the horizontal direction X and unloaded to the outside of the housing 6 from the opening 62 of the sidewall 6*b*.

The post-stage drying furnace 5 includes rollers 52 and 53 aligned vertically outside the housing 6 on the X1 side to the housing 6 in the horizontal direction X in order to fold the printing medium M over, which is unloaded from the opening 62. The upper roller 52 is disposed with respect to the opening 62 and folds the printing medium M downward in the vertical direction Z while supporting the printing medium M from the back surface M2 side by coming into contact with the back surface M2 of the printing medium M unloaded from the opening 62 toward the X1 side in the horizontal direction X. The lower roller 53 is disposed with respect to the opening 63 and folds the printing medium M toward the X2 side in the horizontal direction X while supporting the printing medium M from the back surface M2 side by coming into contact with the back surface M2 of the printing medium M moving downward from the roller 52. Further, by folding the printing medium M over as above, the front surface M1 and the back surface M2 of the printing medium M are reversed up and down.

Thus, the printing medium M folded over by the roller 53 is loaded into the housing 6 from the opening 63 of the sidewall 6*b*. The printing medium M passing through the sidewall 6*b* through the opening 63 is moved in a middle-stage transfer direction Dm directed from the opening 63 to the opening 64 in parallel with the horizontal direction X and unloaded to the outside of the housing 6 from the opening 64 of the sidewall 6*a*.

The post-stage drying furnace 5 includes air turn bars 54 and 55 aligned vertically outside the housing 6 on the X2 side to the housing 6 in the horizontal direction X in order to fold the printing medium M over, which is unloaded from the opening 64. The upper air turn bar 54 is disposed with respect to the opening 64 and injects air onto the printing medium M from the front surface M1 side of the printing medium M unloaded from the opening 64 toward the X2 side in the horizontal direction X. The air turn bar 54 thereby folds the printing medium M downward in the vertical direction Z while supporting the printing medium M from the front surface M1 side with a clearance from the printing medium M. The lower air turn bar 55 is disposed with respect to the opening 65 and injects air onto the printing medium M from the front surface M1 side of the printing medium M moving downward from the air turn bar 54. The air turn bar 55 thereby folds the printing medium M toward the X1 side in the horizontal direction X while supporting the printing medium M from the front surface M1 side with a clearance from the printing medium M. Further, by folding the printing medium M over as above, the front surface M1 and the back surface M2 of the printing medium M are reversed up and down.

Thus, the printing medium M folded over by the air turn bar 55 is loaded into the housing 6 from the opening 65 of the sidewall 6*a*. The printing medium M passing through the sidewall 6*a* through the opening 65 is moved in a lower-stage transfer direction Dl directed from the opening 65 to the opening 66 in parallel with the horizontal direction X and unloaded to the outside of the housing 6 from the opening 66 of the sidewall 6*b*.

Further, the post-stage drying furnace 5 includes a roller 56 disposed outside the housing 6 on the X1 side to the housing 6 in the horizontal direction X in order to support the printing medium M which is unloaded from the opening 66. This roller 56 is disposed with respect to the opening 66 and supports the printing medium M from the back surface M2 side by coming into contact with the back surface M2 of the printing medium M unloaded from the opening 66 toward the X1 side in the horizontal direction X.

The post-stage drying furnace 5 includes six blow-drying parts 7*a* to 7*f* inside the housing 6. Out of these blow-drying parts 7*a* to 7*f*, two blow-drying parts 7*a* and 7*b* are arranged between the openings 61 and 62 in order to dry the printing medium M moving along the upper-stage transfer direction Du, two blow-drying parts 7*c* and 7*d* are arranged between the openings 63 and 64 in order to dry the printing medium M moving along the middle-stage transfer direction Dm, and two blow-drying parts 7*e* and 7*f* are arranged between the openings 65 and 66 in order to dry the printing medium M moving along the lower-stage transfer direction Dl.

Figure 5:
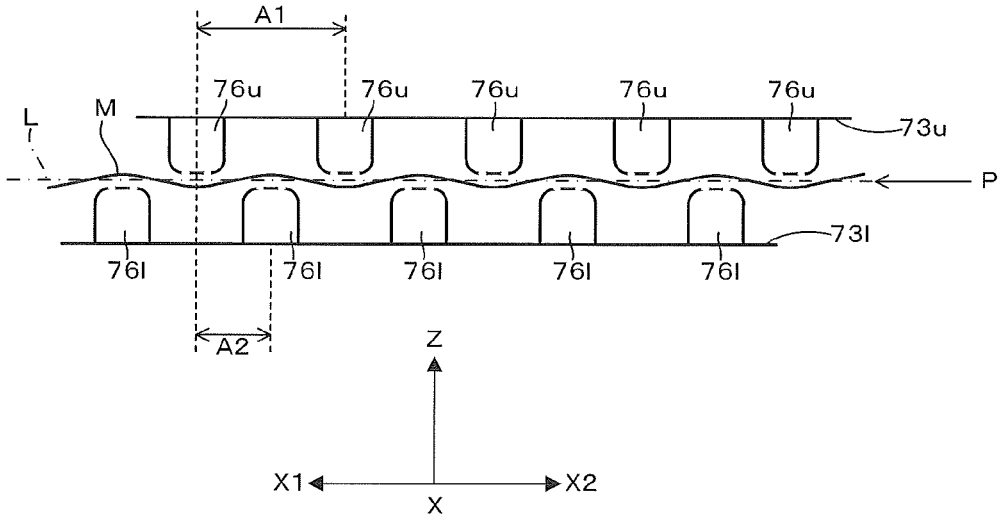
FIG. 5 is a schematic view showing a partially-enlarged blow-drying part.

FIG. 5 is a schematic view showing a partially-enlarged blow-drying part. Subsequently, with reference to FIG. 5 as well as the preceding figures, the blow-drying parts 7*a* to 7*f* will be described. Further, the blow-drying parts 7*a* to 7*f* each have a common constitution. For this reason, the common constitution will be mainly described with the blow-drying part 7*a* taken as an example, and then particular constitutions of the blow-drying parts 7*b* to 7*f* will be described.

The blow-drying part 7*a* is disposed to face the opening 61 in the upper-stage transfer direction Du. This blow-drying part 7*a* has blower units 71*u* and 71*l* disposed on the upper side and the lower side, respectively, to the printing medium M moving in the upper-stage transfer direction Du.

The upper blower unit 71*u* has a blower chamber 72*u* extended in the horizontal direction X on the upper side to the printing medium M. Both end surfaces of the blower chamber 72*u* in the horizontal direction X are planes perpendicular to the horizontal direction X and in parallel with the vertical direction Z. To the blower chamber 72*u*, supplied is hot air generated by heating air by an externally-provided heater. A lower surface of the blower chamber 72*u* is a nozzle arrangement plane 73*u* facing, from upward, the front surface M1 (upper surface) of the printing medium M facing upward. The nozzle arrangement plane 73*u* is a plane in parallel with the horizontal direction X and perpendicular to the vertical direction Z. Further, the blower unit 71*u* has a plurality of nozzles 76*u* aligned at a predetermined pitch A1 in the horizontal direction X on this nozzle arrangement plane 73*u*. Thus, the plurality of nozzles 76*u* are aligned between the nozzle arrangement plane 73*u* and the front surface M1 of the printing medium M to face the front surface M1 of the printing medium M. Each of the nozzles 76*u* communicates with the blower chamber 72*u* and the hot air supplied to the blower chamber 72*u* is injected onto the front surface M1 of the printing medium M from each nozzle 76*u*.

The lower blower unit 71*l* has a blower chamber 72*l* extended in the horizontal direction X on the lower side to the printing medium M. Both end surfaces of the blower chamber 72*l* in the horizontal direction X are planes perpendicular to the horizontal direction X and in parallel with the vertical direction Z. To the blower chamber 72*l*, the above-described hot air is suppled. An upper surface of the blower chamber 72*l* is a nozzle arrangement plane 73*l* facing, from downward, the back surface M2 (lower surface) of the printing medium M facing downward. The nozzle arrangement plane 73*l* is a plane in parallel with the horizontal direction X and perpendicular to the vertical direction Z. Further, the blower unit 71*l* has a plurality of nozzles 76*l* aligned at the predetermined pitch A1 in the horizontal direction X on this nozzle arrangement plane 73*l*. Thus, the plurality of nozzles 76*l* are aligned between the nozzle arrangement plane 73*l* and the back surface M2 of the printing medium M to face the back surface M2 of the printing medium M. Each of the nozzles 76*l* communicates with the blower chamber 72*l* and the hot air supplied to the blower chamber 72*l* is injected onto the back surface M2 of the printing medium M from each nozzle 76*l*.

Thus, the blower unit 71*u* and the blower unit 71*l* sandwich the printing medium M. In other words, the printing medium M moving in the upper-stage transfer direction Du passes through a dry path P formed between the blower unit 71*u* and the blower unit 71*l*. Thus, the blow-drying part 7*a* injects the hot air from the blower units 71*u* and 71*l* disposed on both sides of the dry path P onto the printing medium M passing through the dry path P after being loaded to the opening 61, to thereby dry the printing medium M, the dry path P facing the opening 61 in the upper-stage transfer direction Du.

Each upper nozzle 76*u* faces a range between adjacent two lower nozzles 76*l* in the horizontal direction X from upward, and each lower nozzle 76*l* faces a range between adjacent two upper nozzles 76*u* in the horizontal direction X from downward. Specifically, in the horizontal direction X, the upper nozzles 76*u* and the lower nozzles 76*l* are arranged alternately at a pitch A2 which is half the pitch A1, and in other words, arranged in a staggered manner. Such a staggered arrangement of the nozzles 76*u* and 76*l* is achieved by shifting respective positions of the blower chambers 72*u* and 72*l* relative to each other in the horizontal direction X. In other words, the blower chamber 72*l* protrudes toward the sidewall 6*a* side relative to the blower chamber 72*u* in the horizontal direction X.

In such a configuration, a portion of the printing medium M, which faces the upper nozzle 76*u*, is pushed downward by the hot air from this nozzle 76*u*, to lean downward from a transfer center line L, and a portion of the printing medium M, which faces the lower nozzle 76*l*, is pushed upward by the hot air from this nozzle 76*l*, to lean upward from the transfer center line L. Herein, the transfer center line L is a horizontal virtual straight line whose respective distances from the nozzles 76*u* and 76*l* in the vertical direction Z are equal to each other. Therefore, the printing medium M passing through the dry path P has a wavy shape between the upper side and the lower side of the transfer center line L. Thus, the printing medium M passes through the dry path P while waving.

Further, these blower units 71*u* and 71*l* are supported by the housing 6. Specifically, the blower units 71*u* and 71*l* are each attached to the housing 6 with a fastening member such as a screw or the like. Furthermore, by adjusting an attachment position of one of the blower units 71*u* and 71*l* in the vertical direction Z, it is possible to adjust the positional relation (interval) between the blower units 71*u* and 71*l* in the vertical direction Z.

The blow-drying part 7*b* is disposed on the downstream side of the blow-drying part 7*a* in the upper-stage transfer direction Du and faces the opening 62 in the upper-stage transfer direction Du. Like the blow-drying part 7*a*, this blow-drying part 7*b* has the blower units 71*u* and 71*l* which sandwich, from the vertical direction Z, the printing medium M moving along the upper-stage transfer direction Du. Further, in the blow-drying part 7*b*, the blower unit 71*u* protrudes toward the sidewall 6*b* side relative to the blower unit 71*l* in the horizontal direction X. This blow-drying part 7*b* injects the hot air from the blower units 71*u* and 71*l* disposed on both sides of the dry path P onto the printing medium M passing through the dry path P before being unloaded from the opening 62, to thereby dry the printing medium M, the dry path P facing the opening 62 in the upper-stage transfer direction Du.

The blow-drying part 7*c* is disposed, facing the opening 63 from the middle-stage transfer direction Dm. Like the blow-drying part 7*a*, this blow-drying part 7*c* has the blower units 71*u* and 71*l* which sandwich the printing medium M from the vertical direction Z. Since the blow-drying part 7*c* is disposed with respect to the middle-stage transfer direction Dm, however, the blower units 71*u* and 71*l* of the blow-drying part 7*c* sandwich, from the vertical direction Z, the printing medium M moving along the middle-stage transfer direction Dm. Further, since the printing medium M is turned upside down while being folded over by the rollers 52 and 53, the blower unit 71*u* injects the hot air onto the back surface M2 (upper surface) of the printing medium M and the blower unit 71*l* injects the hot air onto the front surface M1 (lower surface) of the printing medium M. Furthermore, in the blow-drying part 7*c*, the blower unit 71*l* protrudes toward the sidewall 6*b* side relative to the blower unit 71*u* in the horizontal direction X. This blow-drying part 7*c* injects the hot air from the blower units 71*u* and 71*l* disposed on both sides of the dry path P onto the printing medium M passing through the dry path P after being loaded to the opening 63, to thereby dry the printing medium M, the dry path P facing the opening 63 in the middle-stage transfer direction Dm.

The blow-drying part 7*d* is disposed on the downstream side of the blow-drying part 7*c* in the middle-stage transfer direction Dm and faces the opening 64 from the middle-stage transfer direction Dm. Like the blow-drying part 7*c*, this blow-drying part 7*d* has the blower units 71*u* and 71*l* which sandwich, from the vertical direction Z, the printing medium M moving in the middle-stage transfer direction Dm. Further, in the blow-drying part 7*d*, the blower unit 71*u* protrudes toward the sidewall 6*a* side relative to the blower unit 71*l* in the horizontal direction X. This blow-drying part 7*d* injects the hot air from the blower units 71*u* and 71*l* disposed on both sides of the dry path P onto the printing medium M passing through the dry path P before being unloaded from the opening 64, to thereby dry the printing medium M, the dry path P facing the opening 64 in the middle-stage transfer direction Dm.

The blow-drying part 7*e* is disposed, facing the opening 65 from the lower-stage transfer direction Dl. Like the blow-drying part 7*a*, this blow-drying part 7*e* has the blower units 71*u* and 71*l* which sandwich the printing medium M from the vertical direction Z. Since the blow-drying part 7*e* is disposed with respect to the lower-stage transfer direction Dl, however, the blower units 71*u* and 71*l* of the blow-drying part 7*e* sandwich, from the vertical direction Z, the printing medium M moving along the lower-stage transfer direction Dl. Further, in the blow-drying part 7*e*, the blower unit 71*l* protrudes toward the sidewall 6*a* side relative to the blower unit 71*u* in the horizontal direction X. This blow-drying part 7*e* injects the hot air from the blower units 71*u* and 71*l* disposed on both sides of the dry path P onto the printing medium M passing through the dry path P after being loaded to the opening 65, to thereby dry the printing medium M, the dry path P facing the opening 65 in the lower-stage transfer direction Dl.

The blow-drying part 7*f* is disposed on the downstream side of the blow-drying part 7*e* in the lower-stage transfer direction Dl and faces the opening 66 from the lower-stage transfer direction Dl. Like the blow-drying part 7*e*, this blow-drying part 7*f* has the blower units 71*u* and 71*l* which sandwich, from the vertical direction Z, the printing medium M moving in the lower-stage transfer direction Dl. Further, in the blow-drying part 7*f*, the blower unit 71*u* protrudes toward the sidewall 6*b* side relative to the blower unit 71*l* in the horizontal direction X. This blow-drying part 7*f* injects the hot air from the blower units 71*u* and 71*l* disposed on both sides of the dry path P onto the printing medium M passing through the dry path P before being unloaded from the opening 66, to thereby dry the printing medium M, the dry path P facing the opening 66 in the lower-stage transfer direction Dl.

Further, the post-stage drying furnace 5 includes exhaust parts 8*a* and 8*b* inside the housing 6 and the exhaust parts 8*a* and 8*b* exhaust air from the inside of the housing 6 to the outside thereof. The exhaust part 8*a* is disposed adjacent to the sidewall 6*a* at the end of the X2 side in the housing 6 and positioned between the blow-drying parts 7*a*, 7*d*, 7*e* and the sidewall 6*a*. The exhaust part 8*b* is disposed adjacent to the sidewall 6*b* at the end of the X1 side in the housing 6 and positioned between the blow-drying parts 7*b*, 7*c*, 7*f* and the sidewall 6*b*. These exhaust parts 8*a* and 8*b* each include a common constitution. For this reason, the common constitution will be mainly described with the exhaust part 8*a* taken as an example, and then a particular constitution of the exhaust part 8*b* will be described.

The exhaust part 8*a* has four exhaust chambers 81 to 84 aligned in the vertical direction Z. The exhaust chamber 81 is disposed on the upper side to the printing medium M moving between the opening 61 and the opening 62 in the upper-stage transfer direction Du. The exhaust chamber 81 has a lower plate 812 extended in the horizontal direction X from the sidewall 6*a* of the housing 6 toward the inside (X1 side). A lower surface of the lower plate 812 faces, from upward, the front surface M1 (upper surface) of the printing medium M moving along the upper-stage transfer direction Du and is positioned at the same height as the nozzle arrangement plane 73*u* of the blower unit 71*u* of the blow-drying part 7*a*. Further, the exhaust chamber 81 has a side plate 813 extended upward in parallel with the vertical direction Z from an end of the lower plate 812 on the opposite side (X1 side) to the sidewall 6*a*. Then, an air inlet is opened in each of the lower plate 812 and the side plate 813.

The exhaust chamber 82 is disposed between the printing medium M moving between the opening 61 and the opening 62 in the upper-stage transfer direction Du and the printing medium M moving between the opening 63 and the opening 64 in the middle-stage transfer direction Dm. The exhaust chamber 82 has an upper plate 821 and a lower plate 822 each extended in the horizontal direction X from the sidewall 6*a* of the housing 6 toward the inside (X1 side). An upper surface of the upper plate 821 faces, from downward, the back surface M2 (lower surface) of the printing medium M moving along the upper-stage transfer direction Du and is positioned at the same height as the nozzle arrangement plane 73*l* of the blower unit 71*l* of the blow-drying part 7*a*. A lower surface of the lower plate 822 faces, from upward, the back surface M2 (upper surface) of the printing medium M moving along the middle-stage transfer direction Dm and is positioned at the same height as the nozzle arrangement plane 73*u* of the blower unit 71*u* of the blow-drying part 7*d*. Further, the exhaust chamber 82 has a side plate 823 extended in parallel with the vertical direction Z between respective ends of the upper plate 821 and the lower plate 822 on the opposite side (X1 side) to the sidewall 6*a*. Then, an air inlet is opened in each of the upper plate 821, the lower plate 822, and the side plate 823.

The exhaust chamber 83 is disposed between the printing medium M moving between the opening 63 and the opening 64 in the middle-stage transfer direction Dm and the printing medium M moving between the opening 65 and the opening 66 in the lower-stage transfer direction Dl. The exhaust chamber 83 has an upper plate 831 and a lower plate 832 each extended in the horizontal direction X from the sidewall 6*a* of the housing 6 toward the inside (X1 side). An upper surface of the upper plate 831 faces, from downward, the front surface M1 (lower surface) of the printing medium M moving along the middle-stage transfer direction Dm and is positioned at the same height as the nozzle arrangement plane 73*l* of the blower unit 71*l* of the blow-drying part 7*d*. A lower surface of the lower plate 832 faces, from upward, the front surface M1 (upper surface) of the printing medium M moving along the lower-stage transfer direction Dl and is positioned at the same height as the nozzle arrangement plane 73*u* of the blower unit 71*u* of the blow-drying part 7*e*. Further, the exhaust chamber 83 has a side plate 833 extended in parallel with the vertical direction Z between respective ends of the upper plate 831 and the lower plate 832 on the opposite side (X1 side) to the sidewall 6*a*. Then, an air inlet is opened in each of the upper plate 831, the lower plate 832, and the side plate 833.

The exhaust chamber 84 is disposed on the lower side to the printing medium M moving between the opening 65 and the opening 66 in the lower-stage transfer direction Dl. The exhaust chamber 84 has an upper plate 841 extended in the horizontal direction X from the sidewall 6*a* of the housing 6 toward the inside (X1 side). An upper surface of the upper plate 841 faces, from downward, the back surface M2 (lower surface) of the printing medium M moving along the lower-stage transfer direction Dl and is positioned at the same height as the nozzle arrangement plane 73*l* of the blower unit 71*l* of the blow-drying part 7*e*. Further, the exhaust chamber 84 has a side plate 843 extended downward in parallel with the vertical direction Z from an end of the upper plate 841 on the opposite side (X1 side) to the sidewall 6*a*. Then, an air inlet is opened in each of the upper plate 841 and the side plate 843.

Like the exhaust part 8*a*, the exhaust part 8*b* also has exhaust chambers 81 to 84. Further, in the exhaust part 8*b*, the lower surface of the lower plate 812 of the exhaust chamber 81 is positioned at the same height as the nozzle arrangement plane 73*u* of the blower unit 71*u* of the blow-drying part 7*b*. The upper surface of the upper plate 821 of the exhaust chamber 82 is positioned at the same height as the nozzle arrangement plane 73*l* of the blower unit 71*l* of the blow-drying part 7*b*, and the lower surface of the lower plate 822 of the exhaust chamber 82 is positioned at the same height as the nozzle arrangement plane 73*u* of the blower unit 71*u* of the blow-drying part 7*c*. The upper surface of the upper plate 831 of the exhaust chamber 83 is positioned at the same height as the nozzle arrangement plane 73*l* of the blower unit 71*l* of the blow-drying part 7*c*, and the lower surface of the lower plate 832 of the exhaust chamber 83 is positioned at the same height as the nozzle arrangement plane 73*u* of the blower unit 71*u* of the blow-drying part 7*f*. The upper surface of the upper plate 841 of the exhaust chamber 84 is positioned at the same height as the nozzle arrangement plane 73*l* of the blower unit 71*l* of the blow-drying part 7*f*.

These exhaust chambers 81 to 84 of the exhaust parts 8*a* and 8*b* are connected to a common exhaust blower (not shown). Therefore, the exhaust part 8 sucks the air from the inside of the housing 6 by the respective air inlets of the exhaust chambers 81 to 84 of the exhaust parts 8*a* and 8*b* and exhausts the air to the outside of the housing 6. Further, there may be a configuration where the exhaust chambers 81 to 84 are connected to a plurality of exhaust blowers, respectively, and the exhaust part 8 exhausts part of the air to the outside of the housing 6 while bringing the remaining part of the air back to the blow-drying parts 7*a* to 7*e*, to thereby circulate the part of the air. It is thereby possible to perform an efficient drying operation using the exhaust heat.

At the end portion of the post-stage drying furnace 5 on the X2 side, the respective side plates 813, 823, 833, and 843 of the exhaust chambers 81, 82, 83, 84 are disposed at the same position in the horizontal direction X, and in other words, aligned in a line in the vertical direction Z. On the other hand, the blow-drying parts 7*a*, 7*d*, 7*e* face these side plates 813, 823, 833, 843 with respective intervals from the horizontal direction X.

Specifically, in the horizontal direction X, the blower chamber 72*u* of the blow-drying part 7*a* faces a lower end of the side plate 813 of the exhaust chamber 81 with an interval Δ1 interposed therebetween, the blower chamber 72*l* of the blow-drying part 7*a* and the blower chamber 72*u* of the blow-drying part 7*d* face an upper end and a lower end of the side plate 823 of the exhaust chamber 82 with intervals Δ2 and Δ3 interposed therebetween, respectively, the blower chamber 72*l* of the blow-drying part 7*d* and the blower chamber 72*u* of the blow-drying part 7*e* face an upper end and a lower end of the side plate 833 of the exhaust chamber 83 with intervals Δ4 and Δ5 interposed therebetween, respectively, and the blower chamber 72*l* of the blow-drying part 7*e* faces an upper end of the side plate 843 of the exhaust chamber 84 with an interval Δ6 interposed therebetween.

Similarly, at the end portion of the post-stage drying furnace 5 on the X1 side, the respective side plates 813, 823, 833, 843 of the exhaust chambers 81, 82, 83, 84 are disposed at the same position in the horizontal direction X, and in other words, aligned in a line in the vertical direction Z. On the other hand, the blow-drying parts 7*b*, 7*c*, 7*f* face these side plates 813, 823, 833, 843 from the horizontal direction X.

Specifically, in the horizontal direction X, the blower chamber 72*u* of the blow-drying part 7*b* faces the lower end of the side plate 813 of the exhaust chamber 81 with an interval Δ7 interposed therebetween, the blower chamber 72*l* of the blow-drying part 7*b* and the blower chamber 72*u* of the blow-drying part 7*c* face the upper end and the lower end of the side plate 823 of the exhaust chamber 82 with intervals Δ8 and Δ9 interposed therebetween, respectively, the blower chamber 72*l* of the blow-drying part 7*c* and the blower chamber 72*u* of the blow-drying part 7*f* face the upper end and the lower end of the side plate 833 of the exhaust chamber 83 with intervals Δ10 and Δ11 interposed therebetween, respectively, and the blower chamber 72*l* of the blow-drying part 7*f* faces the upper end of the side plate 843 of the exhaust chamber 84 with an interval Δ12 interposed therebetween.

Correspondingly to this, the post-stage drying furnace 5 includes rectifying plates 91 and 92 disposed for the intervals Δ1 to Δ3 and Δ6 to Δ12 except the intervals Δ4 and Δ5 out of the above-described intervals Δ1 to Δ12. Each of these rectifying plates 91 and 92 is a plate having planes in parallel with the horizontal direction X and perpendicular to the vertical direction Z as upper and lower main surfaces. Further, the two types of rectifying plates 91 and 92 are provided in accordance with a difference in the length of the intervals Δ1 to Δ3 and Δ6 to Δ12, and the length of the rectifying plate 91 is longer than that of the rectifying plate 92 in the horizontal direction X. Specifically, in each of the blow-drying parts 7*a* to 7*f*, one of the blower chamber 72*u* of the blower unit 71*u* and the blower chamber 72*l* of the blower unit 71*l* protrudes toward either one side of the sidewalls 6*a* and 6*b* relative to the other one, and therefore each of the respective lengths of the intervals Δ1 to Δ12 is either one of two types of lengths. Correspondingly to this, provided are the rectifying plates 91 and 92 having different lengths.

Describing in more detail, on the X2 side in the horizontal direction X, the rectifying plate 91 is disposed in the interval Δ1 between the blower chamber 72*u* of the blow-drying part 7*a* and the side plate 813 of the exhaust chamber 81. The lower surface of the rectifying plate 91 is a rectifying plane Sc which faces, from upward, the front surface M1 of the printing medium M moving along the upper-stage transfer direction Du, to stabilize airflow in the vicinity of the printing medium M. This rectifying plane Sc is positioned at the same height of the nozzle arrangement plane 73*u* of the adjacent blower chamber 72*u* and the lower surface of the lower plate 812 of the adjacent exhaust chamber 81, being flush therewith. In the horizontal direction X, the length of the rectifying plate 91 is equal to the length of the interval Δ1, and the rectifying plate 91 is in contact with the blower chamber 72*u* and the side plate 813, to thereby close the interval Δ1. This rectifying plate 91 is attached detachably to the blower chamber 72*u* and the side plate 813 by using a fastening member such as a screw or the like.

The rectifying plate 92 is disposed in the interval Δ2 between the blower chamber 72*l* of the blow-drying part 7*a* and the side plate 823 of the exhaust chamber 82. The upper surface of the rectifying plate 92 is the rectifying plane Sc which faces, from downward, the back surface M2 of the printing medium M moving along the upper-stage transfer direction Du, to stabilize airflow in the vicinity of the printing medium M. This rectifying plane Sc is positioned at the same height of the nozzle arrangement plane 73*l* of the adjacent blower chamber 72*l* and the upper surface of the upper plate 821 of the adjacent exhaust chamber 82, being flush therewith. In the horizontal direction X, the length of the rectifying plate 92 is equal to the length of the interval Δ2, and the rectifying plate 92 is in contact with the blower chamber 72*l* and the side plate 823, to thereby close the interval Δ2. This rectifying plate 92 is attached detachably to the blower chamber 72*l* and the side plate 823 by using a fastening member such as a screw or the like.

Thus, on both the sides (the front surface M1 side and the back surface M2 side) of the printing medium M passing through the opening 61 and moving toward the dry path P of the blow-drying part 7*a*, the rectifying plates 91 and 92 are disposed. As a result, the airflow in a range sandwiched by the rectifying plates 91 and 92 is stabilized and it is thereby suppress flutter of the printing medium M in the vicinity of the opening 61.

The rectifying plate 92 is disposed in the interval Δ3 between the blower chamber 72*u* of the blow-drying part 7*d* and the side plate 823 of the exhaust chamber 82. The lower surface of the rectifying plate 92 is the rectifying plane Sc which faces, from upward, the back surface M2 of the printing medium M moving along the middle-stage transfer direction Dm, to stabilize airflow in the vicinity of the printing medium M. This rectifying plane Sc is positioned at the same height of the nozzle arrangement plane 73*u* of the adjacent blower chamber 72*u* and the lower surface of the lower plate 822 of the adjacent exhaust chamber 82, being flush therewith. In the horizontal direction X, the length of the rectifying plate 92 is equal to the length of the interval Δ3, and the rectifying plate 92 is in contact with the blower chamber 72*u* and the side plate 823, to thereby close the interval Δ3. This rectifying plate 92 is attached detachably to the blower chamber 72*u* and the side plate 823 by using a fastening member such as a screw or the like.

Neither of the rectifying plates 91 and 92 is disposed in the interval Δ4 between the blower chamber 72*l* of the blow-drying part 7*d* and the side plate 833 of the exhaust chamber 83, and the interval Δ4 is open.

Thus, on the back surface M2 side (the other side) of the printing medium M passing through the dry path P of the blow-drying part 7*d* and moving toward the opening 64, rectifying plate 92 is disposed. As a result, the airflow between the rectifying plate 92 and the back surface M2 of the printing medium M can be stabilized. Further, on the front surface M1 side (one side) of the printing medium M, the air injected form the air turn bar 54 outside the opening 64 onto the front surface M1 of the printing medium M moves along the front surface M1 of the printing medium M as indicated by the arrow W of FIG. 3 and enters the housing 6 from the opening 64. With the flow of the air, the airflow on the front surface M1 side of the printing medium M in the vicinity of the opening 64 can be stabilized. As a result, it is possible to suppress the flutter of the printing medium M in the vicinity of the opening 64.

Neither of the rectifying plates 91 and 92 is disposed in the interval Δ5 between the blower chamber 72*u* of the blow-drying part 7*e* and the side plate 833 of the exhaust chamber 83, and the interval Δ5 is open.

The rectifying plate 92 is disposed in the interval Δ6 between the blower chamber 72*l* of the blow-drying part 7*e* and the side plate 843 of the exhaust chamber 84. The upper surface of the rectifying plate 92 is the rectifying plane Sc which faces, from downward, the back surface M2 of the printing medium M moving along the lower-stage transfer direction Dl, to stabilize airflow in the vicinity of the printing medium M. This rectifying plane Sc is positioned at the same height of the nozzle arrangement plane 73*l* of the adjacent blower chamber 72*l* and the upper surface of the upper plate 841 of the adjacent exhaust chamber 84, being flush therewith. In the horizontal direction X, the length of the rectifying plate 92 is equal to the length of the interval Δ6, and the rectifying plate 92 is in contact with the blower chamber 72*l* and the side plate 843, to thereby close the interval Δ6. This rectifying plate 92 is attached detachably to the blower chamber 72*l* and the side plate 843 by using a fastening member such as a screw or the like.

Thus, on the back surface M2 side (the other side) of the printing medium M passing through the opening 65 and moving toward the blow-drying part 7*e*, the rectifying plate 92 is disposed. As a result, the airflow between the rectifying plate 92 and the back surface M2 of the printing medium M can be stabilized. Further, on the front surface M1 side (one side) of the printing medium M, the air injected form the air turn bar 55 outside the opening 65 onto the front surface M1 of the printing medium M moves along the front surface M1 of the printing medium M as indicated by the arrow W of FIG. 3 and enters the housing 6 from the opening 65. With the flow of the air, the airflow on the front surface M1 side of the printing medium M in the vicinity of the opening 65 can be stabilized. As a result, it is possible to suppress the flutter of the printing medium M in the vicinity of the opening 65.

On the X1 side in the horizontal direction X, the rectifying plate 92 is disposed in the interval Δ7 between the blower chamber 72*u* of the blow-drying part 7*b* and the side plate 813 of the exhaust chamber 81. The lower surface of the rectifying plate 92 is the rectifying plane Sc which faces, from upward, the front surface M1 of the printing medium M moving along the upper-stage transfer direction Du, to stabilize airflow in the vicinity of the printing medium M. This rectifying plane Sc is positioned at the same height of the nozzle arrangement plane 73*u* of the adjacent blower chamber 72*u* and the lower surface of the lower plate 812 of the adjacent exhaust chamber 81, being flush therewith. In the horizontal direction X, the length of the rectifying plate 92 is equal to the length of the interval Δ7, and the rectifying plate 92 is in contact with the blower chamber 72*u* and the side plate 813, to thereby close the interval Δ7. This rectifying plate 92 is attached detachably to the blower chamber 72*u* and the side plate 813 by using a fastening member such as a screw or the like.

The rectifying plate 91 is disposed in the interval Δ8 between the blower chamber 72*l* of the blow-drying part 7*b* and the side plate 823 of the exhaust chamber 82. The upper surface of the rectifying plate 91 is the rectifying plane Sc which faces, from downward, the back surface M2 of the printing medium M moving along the upper-stage transfer direction Du, to stabilize airflow in the vicinity of the printing medium M. This rectifying plane Sc is positioned at the same height of the nozzle arrangement plane 73*l* of the adjacent blower chamber 72*l* and the upper surface of the upper plate 821 of the adjacent exhaust chamber 82, being flush therewith. In the horizontal direction X, the length of the rectifying plate 91 is equal to the length of the interval Δ8, and the rectifying plate 91 is in contact with the blower chamber 72*l* and the side plate 823, to thereby close the interval Δ8. This rectifying plate 91 is attached detachably to the blower chamber 72*l* and the side plate 823 by using a fastening member such as a screw or the like.

Thus, on both the sides (the front surface M1 side and the back surface M2 side) of the printing medium M passing through the dry path P of the blow-drying part 7*b* and moving toward the opening 62, the rectifying plates 91 and 92 are disposed. As a result, the airflow in a range sandwiched by the rectifying plates 91 and 92 is stabilized and it is thereby suppress the flutter of the printing medium M in the vicinity of the opening 62.

The rectifying plate 91 is disposed in the interval Δ9 between the blower chamber 72*u* of the blow-drying part 7*c* and the side plate 823 of the exhaust chamber 82. The lower surface of the rectifying plate 91 is the rectifying plane Sc which faces, from upward, the back surface M2 of the printing medium M moving along the middle-stage transfer direction Dm, to stabilize airflow in the vicinity of the printing medium M. This rectifying plane Sc is positioned at the same height of the nozzle arrangement plane 73*u* of the adjacent blower chamber 72*u* and the lower surface of the lower plate 822 of the adjacent exhaust chamber 82, being flush therewith. In the horizontal direction X, the length of the rectifying plate 91 is equal to the length of the interval Δ9, and the rectifying plate 91 is in contact with the blower chamber 72*u* and the side plate 823, to thereby close the interval Δ9. This rectifying plate 91 is attached detachably to the blower chamber 72*u* and the side plate 823 by using a fastening member such as a screw or the like.

The rectifying plate 92 is disposed in the interval Δ10 between the blower chamber 72*l* of the blow-drying part 7*c* and the side plate 833 of the exhaust chamber 83. The upper surface of the rectifying plate 92 is the rectifying plane Sc which faces, from downward, the front surface M1 of the printing medium M moving along the middle-stage transfer direction Dm, to stabilize airflow in the vicinity of the printing medium M. This rectifying plane Sc is positioned at the same height of the nozzle arrangement plane 73*l* of the adjacent blower chamber 72*l* and the upper surface of the upper plate 831 of the adjacent exhaust chamber 83, being flush therewith. In the horizontal direction X, the length of the rectifying plate 92 is equal to the length of the interval Δ10, and the rectifying plate 92 is in contact with the blower chamber 72*l* and the side plate 833, to thereby close the interval Δ10. This rectifying plate 92 is attached detachably to the blower chamber 72*l* and the side plate 833 by using a fastening member such as a screw or the like.

Thus, on both the sides (the front surface M1 side and the back surface M2 side) of the printing medium M passing through the opening 63 and moving toward the dry path P of the blow-drying part 7*c*, the rectifying plates 91 and 92 are disposed. As a result, the airflow in a range sandwiched by the rectifying plates 91 and 92 is stabilized and it is thereby suppress the flutter of the printing medium M in the vicinity of the opening 63.

The rectifying plate 92 is disposed in the interval Δ11 between the blower chamber 72*u* of the blow-drying part 7*f* and the side plate 833 of the exhaust chamber 83. The lower surface of the rectifying plate 92 is the rectifying plane Sc which faces, from upward, the front surface M1 of the printing medium M moving along the lower-stage transfer direction Dl, to stabilize airflow in the vicinity of the printing medium M. This rectifying plane Sc is positioned at the same height of the nozzle arrangement plane 73*u* of the adjacent blower chamber 72*u* and the lower surface of the lower plate 832 of the adjacent exhaust chamber 83, being flush therewith. In the horizontal direction X, the length of the rectifying plate 92 is equal to the length of the interval Δ11, and the rectifying plate 92 is in contact with the blower chamber 72*u* and the side plate 833, to thereby close the interval Δ11. This rectifying plate 92 is attached detachably to the blower chamber 72*u* and the side plate 833 by using a fastening member such as a screw or the like.

The rectifying plate 91 is disposed in the interval Δ12 between the blower chamber 72*l* of the blow-drying part 7*f* and the side plate 843 of the exhaust chamber 84. The upper surface of the rectifying plate 91 is the rectifying plane Sc which faces, from downward, the back surface M2 of the printing medium M moving along the lower-stage transfer direction Dl, to stabilize airflow in the vicinity of the printing medium M. This rectifying plane Sc is positioned at the same height of the nozzle arrangement plane 73*l* of the adjacent blower chamber 72*l* and the upper surface of the upper plate 841 of the adjacent exhaust chamber 84, being flush therewith. In the horizontal direction X, the length of the rectifying plate 91 is equal to the length of the interval Δ12, and the rectifying plate 91 is in contact with the blower chamber 72*l* and the side plate 843, to thereby close the interval Δ12. This rectifying plate 91 is attached detachably to the blower chamber 72*l* and the side plate 843 by using a fastening member such as a screw or the like.

Thus, on both the sides (the front surface M1 side and the back surface M2 side) of the printing medium M passing through the dry path P of the blow-drying part 7*f* and moving toward the opening 66, the rectifying plates 91 and 92 are disposed. As a result, the airflow in a range sandwiched by the rectifying plates 91 and 92 is stabilized and it is thereby suppress the flutter of the printing medium M in the vicinity of the opening 66.

In the above-described embodiment having the above-described configuration, the rectifying plates 91, 92 disposed between the blow-drying parts 7*a*-7*f* and the exhaust parts 8*a*, 8*b* in the housing 6 of the post-stage drying furnace 5 face the printing medium M being transferred in the transfer directions Du, Dm, Dl. Therefore, it is possible to suppress disturbance of the airflow in an area between the blow-drying parts 7*a*-7*f* and the exhaust parts 8*a*, 8*b* by the rectifying plates 91, 92. As a result, it becomes possible to suppress the flutter of the printing medium M in the vicinity of the openings 61-66 due to an effect of the exhaust by the exhaust parts 8*a*-8*b* provided between the blow-drying parts 7*a*-7*f* and the openings 61-66 of the housing 6.

Further, the printing medium M moving between the inside and the outside of the sidewalls 6*a*, 6*b* through the openings 61-63, 66 in the transfer directions Du, Dm, Dl are supported by the rollers 51-53, 56 outside the sidewalls 6*a*, 6*b*. Thus, on both the sides of the printing medium M passing through the openings 61-63, 66 provided with the rollers 51-53, 56, the rectifying plates 91, 92 are disposed. Thus, by using the rectifying plates 91, 92 disposed on both the sides of the printing medium M, it is reliably possible to suppress the flutter of the printing medium M in the vicinity of the openings 61-63, 66.

Furthermore, the printing medium M moving between the inside and the outside of the sidewall 6*a* through the openings 64, 65 in the transfer directions Du, Dm, Dl are supported by the air turn bars 54, 55 outside the sidewall 6*a*. Thus, with respect to the printing medium M passing through the openings 64, 65 provided with the air turn bars 54, 55, neither of the rectifying plates 91 and 92 is disposed on the front surface M1 side (one side) where the printing medium M is supported by the air turn bars 54, 55, and the rectifying plate 92 is disposed only on the back surface M2 side (the other side). In such a configuration, the air injected from the air turn bars 54, 55 disposed on the front surface M1 side of the printing medium M moves along the front surface M1 of the printing medium M and enters the housing 6 through the openings 64, 65. The flow of the air serves to suppress the flutter of the printing medium M, from the front surface M1 side, in the vicinity of the openings 64, 65. Further, the rectifying plate 92 is disposed on the back surface M2 side of the printing medium M, and this rectifying plate 92 serves to suppress the flutter of the printing medium M, from the back surface M2 side, in the vicinity of the openings 64, 65. Therefore, it is possible to suppress the flutter of the printing medium M, from both the sides of the printing medium M, in the vicinity of the openings 64, 65 while reducing the number of components of the post-stage drying furnace 5 by providing the rectifying plate 92 only on the back surface M2 side out of both the sides of the printing medium M.

Further, the rectifying plates 91, 92 are in contact with the blow-drying parts 7*a*-7*f* and the exhaust parts 8*a*, 8*b* and close the intervals Δ1-Δ3 and Δ6-Δ12 between the blow-drying parts 7*a*-7*f* and the exhaust parts 8*a*, 8*b*. It is thereby possible to reliably suppress the flutter of the printing medium M in the vicinity of the openings 61-66.

Furthermore, the rectifying plates 91, 92 are arranged so that the nozzle arrangement planes 73*u*, 73*l* of the blower units 71*u*, 71*l* and the rectifying planes Sc of the rectifying plates 91, 92 are flush. In such a configuration, since there arises no disturbance of airflow due to the level difference between the nozzle arrangement planes 73*u*, 73*l* and the rectifying planes Sc of the rectifying plates 91, 92, it is possible to reliably suppress the flutter of the printing medium M in the vicinity of the openings 61-66.

Further, the rectifying plates 91, 92 are supported by the blower units 71*u*, 71*l*. Thus, since the blower units 71*u*, 71*l* have a function of supporting the rectifying plates 91, 92, it is not necessary to separately provide a mechanism for this function and it is thereby possible to suppress complication of the configuration of the post-stage drying furnace 5.

Furthermore, the housing 6 supports the two blower units 71*u*, 71*l* so that the interval between the two blower units 71*u*, 71*l* may be adjustable. In contrast to this, the rectifying plates 91, 92 are detachable/attachable from/to the blower units 71*u*, 71*l*. In such a configuration, by adjusting the interval between the two blower units 71*u*, 71*l*, it is possible to perform an operation of making the distance between the blower units 71*u*, 71*l* and the printing medium M appropriate. Further, since the rectifying plates 91, 92 can be detached from the blower units 71*u*, 71*l*, it is possible to perform this operation smoothly.

In the above-described embodiment, the post-stage drying furnace 5 corresponds to one example of a "web drying apparatus" of the present invention, each of the rollers 51-53, 56 corresponds to one example of a "contact support member" of the present invention, each of the air turn bars 54*a*, 55 corresponds to one example of a "floating support member" of the present invention, the housing 6 corresponds to one example of a "housing" of the present invention, each of the sidewalls 6*a*, 6*b* corresponds to one example of a "sidewall" of the present invention, each of the openings 61-66 corresponds to one example of an "opening" of the present invention, each of the blow-drying parts 7*a*-7*f* corresponds to one example of a "blow-drying part" of the present invention, the blower units 71*u*, 71*l* correspond to one example of "two blower units" of the present invention, each of the nozzle arrangement planes 73*u*, 73*l* corresponds to one example of a "nozzle arrangement plane" of the present invention, each of the nozzles 76*u*, 76*l* corresponds to one example of a "nozzle" of the present invention, each of the exhaust parts 8*a*, 8*b* corresponds to one example of an "exhaust part" of the present invention, each of the rectifying plates 91, 92 corresponds to one example of a "rectifying member" of the present invention, each of the upper-stage transfer direction Du, the middle-stage transfer direction Dm, and the lower-stage transfer direction Dl corresponds to one example of a "transfer direction" of the present invention, the printing medium M corresponds to one example of "web" of the present invention, the dry path P corresponds to one example of a "dry path" of the present invention, the rectifying plane Sc corresponds to one example of a "rectifying plane" of the present invention, and the air corresponds to one example of "gas" of the present invention, The present invention is not limited to the above-described embodiment, but numerous modifications and variations other than those described above can be devised without departing from the scope of the invention. For example, the intervals Δ1-Δ3, Δ6-Δ12 do not necessarily need to be closed by the rectifying plates 91, 92. Specifically describing with the interval Δ taken as an example, there may be a clearance between the blower chamber 72*u* of the blow-drying part 7*a* and the rectifying plate 91, or there may be a clearance between the side plate 813 of the exhaust chamber 81 and the rectifying plate 91.

Further, the size or the shape of each of the rectifying plates 91 and 92 may be changed as appropriate. For example, as compared with the pitch A1 at which the nozzles 76*a*, 76*b* are arranged, both the rectifying plates 91 and 92 may be longer, the rectifying plate 91 may be longer and the rectifying plate 92 may be shorter, or both the rectifying plates 91 and 92 may be shorter. Furthermore, two types of rectifying plates 91 and 92 do not need to be provided but the rectifying plates having the same length may be disposed in the intervals Δ1-Δ3, Δ6-Δ12, respectively.

Further, the rectifying plates do not need to be disposed in all the intervals Δ1-Δ3 and Δ6-Δ12, but if a range in which the flutter of the printing medium M increases is experimentally found, the rectifying plate may be disposed only in the intervals in proximity to this range.

Furthermore, the rectifying plates 91 may be disposed in the intervals Δ4, Δ5.

Further, the respective sizes of the intervals Δ1-Δ12 may be changed as appropriate, and may be made the same length.

Furthermore, the arrangement of the nozzles 76*u*, 76*l* may be changed as appropriate, and the nozzles 76*u*, 76*l* may be so arranged as to face each other in the vertical direction Z.

Further, the rectifying plane Sc does not need to be flush with the nozzle arrangement planes 73*u*, 73*l*, but may protrude upward or downward from these nozzle arrangement planes. The same applies to the positional relation between the plates 812, 821, 822, 831, 832, 842 of the exhaust chambers 81-84 and the rectifying plane Sc.

The present invention can be applied to general technology for drying web by blow.

As described above, the web drying apparatus may further comprises: a contact support member which support the web by coming into contact with the web outside the sidewall, the web moving between the inside and the outside of the sidewall through the opening in the transfer direction, wherein the rectifying member is disposed on both sides of the web. In such a configuration, it is possible to reliably suppress the flutter of the web in the vicinity of the opening by the rectifying member disposed on both sides of the web.

The web drying apparatus may further comprises: a floating support member which support the web by injecting gas onto the web outside the sidewall, the web moving between the inside and the outside of the sidewall through the opening in the transfer direction, wherein the floating support member injects gas onto a surface on one side out of both sides of the web, and the rectifying member is disposed on an other side opposite to the one side out of both sides of the web and not disposed on the one side. In such a configuration, the gas injected from the floating support member disposed on one side of the web moves along a surface on the one side of the web and enters the housing from the opening. The flow of the gas serves to suppress the flutter of the web in the vicinity of the opening from the one side. Further, the rectifying member is disposed on the other side of the web, and this rectifying member serves to suppress the flutter of the web in the vicinity of the opening from the other side. Therefore, it is possible to suppress the flutter of the web in the vicinity of the opening from both sides of the web while reducing the number of components of the web drying apparatus by providing the rectifying member only on the other side out of both sides of the web.

The web drying apparatus may be configured so that the rectifying member is in contact with each of the blow-drying part and the exhaust part and closes an interval between the blow-drying part and the exhaust part. It is thereby possible to reliably suppress the flutter of the web in the vicinity of the opening.

The web drying apparatus may be configured so that the blower units has a nozzle arrangement plane in parallel with the transfer direction, which faces the web being transferred in the transfer direction, and a plurality of nozzles arranged on the nozzle arrangement plane in the transfer direction, and injects gas onto the web from each of the plurality of nozzles, and the rectifying member has a rectifying plane in parallel with the transfer direction, which faces the web being transferred in the transfer direction, and the nozzle arrangement plane and the rectifying plane are so arranged as to be flush with each other. In such a configuration, since there arises no disturbance of airflow due to the level difference between the nozzle arrangement plane in the blower unit and the rectifying plane of the rectifying member, it is possible to reliably suppress the flutter of the web in the vicinity of the opening.

The web drying apparatus may be configured so that the rectifying member is supported by the blower units. Thus, by providing the blower unit with a function of supporting the rectifying member, it is not necessary to separately provide a mechanism for this function and it is thereby possible to suppress complication of the configuration of the web drying apparatus.

The web drying apparatus may be configured so that the housing supports the two blower units so that an interval between the two blower units is adjustable, and the rectifying member is detachable/attachable from/to the blower units. In such a configuration, by adjusting the interval between the two blower units, it is possible to perform an operation of making the distance between the blower units and the web appropriate. Further, since the rectifying member can be detached from the blower unit, it is possible to perform this operation smoothly.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A web drying apparatus, comprising:

a blow-drying part which has two blower units arranged on both sides of a web which is transferred in a transfer direction, and injects gas onto the web passing through a dry path between the two blower units;

a housing which houses the blow-drying part, and has a first sidewall provided with a first opening facing the dry path from the transfer direction, through which the web passes in the transfer direction through the first opening, and a second sidewall provided with a second opening facing the dry path from the transfer direction, through which the web passes in the transfer direction through the second opening, the first sidewall and the second sidewall facing each other with an interval in a horizontal direction, the first opening penetrating in the first sidewall in the horizontal direction, the second opening penetrating in the second sidewall in the horizontal direction;

a first exhaust part which is adjacent to the first sidewall and disposed between the first sidewall and the blow-drying part in the housing and exhausts gas from inside of the housing to outside of the housing;

a second exhaust part which is adjacent to the second sidewall and disposed between the second sidewall and the blow-drying part in the housing and exhausts gas from inside of the housing to outside of the housing;

a first rectifying member which is disposed between the blow-drying part and the first exhaust part in the housing and faces the web being transferred in the transfer direction; and a second rectifying member which is disposed between the blow-drying part and the second exhaust part in the housing and faces the web being transferred in the transfer direction.

2. The web drying apparatus according to claim 1, further comprising:

a contact support member which support the web by coming into contact with the web outside the sidewall, the web moving between the inside and the outside of the sidewall through the first or second opening in the transfer direction, wherein the first or second rectifying member is disposed on both sides of the web.

3. The web drying apparatus according to claim 1, further comprising:

a floating support member which supports the web by injecting gas onto the web outside the sidewall, the web moving between the inside and the outside of the sidewall through the first or second opening in the transfer direction, wherein the floating support member injects gas onto a surface on one side of both sides of the web, and the first or second rectifying member is disposed on another side opposite to the one side of both sides of the web and not disposed on the one side.

4. The web drying apparatus according to claim 1, wherein the first rectifying member is in contact with each of the blow-drying part and the first exhaust part and closes an interval between the blow-drying part and the first exhaust part, and the second rectifying member is in contact with each of the blow-drying part and the second exhaust part and closes an interval between the blow-drying part and the second exhaust part.

5. The web drying apparatus according to claim 4, wherein the blower units has a nozzle arrangement plane in parallel with the transfer direction, which faces the web being transferred in the transfer direction, and a plurality of nozzles arranged on the nozzle arrangement plane in the transfer direction, and injects gas onto the web from each of the plurality of nozzles, and each of the first and second rectifying members has a rectifying plane in parallel with the transfer direction, which faces the web being transferred in the transfer direction, and the nozzle arrangement plane and the rectifying plane are so arranged as to be flush with each other.

6. The web drying apparatus according to claim 1, wherein each of the first and second rectifying members is supported by the blower units.

7. The web drying apparatus according to claim 6, wherein the housing supports the two blower units so that an interval between the two blower units is adjustable, and each of the first and second rectifying members is detachable/attachable from/to the blower units.

8. A web drying method, comprising:

transferring a web in a transfer direction;

injecting gas from two blower units included in a blow-drying part onto the web passing through a dry path between the two blower units; and exhausting gas from the inside to the outside of a housing which houses the blow-drying part, and has a first sidewall provided with a first opening facing the dry path from the transfer direction, through which the web passes in the transfer direction through the first opening, and a second sidewall provided with a second opening facing the dry path from the transfer direction, through which the web passes in the transfer direction through the second opening, the first sidewall and the second sidewall facing each other with an interval in a horizontal direction, the first opening penetrating in the first sidewall in the horizontal direction, the second opening penetrating in the second sidewall in the horizontal direction, by a first exhaust part disposed between the first sidewall and the blow-drying part in the housing and a second exhaust part disposed between the second sidewall and the blow-drying part in the housing, wherein a first rectifying member disposed between the blow-drying part and the first exhaust part in the housing faces the web being transferred in the transfer direction, and wherein a second rectifying member disposed between the blow-drying part and the second exhaust part in the housing faces the web being transferred in the transfer direction.

9. A web drying apparatus, comprising:

a blow-drying part which has two blower units arranged on both sides of web which is transferred in a transfer direction, and injects gas onto the web passing through a dry path between the two blower units;

a housing which has a sidewall provided with an opening facing the dry path from the transfer direction, through which the web passes in the transfer direction through the opening, and houses the blow-drying part;

an exhaust part which is disposed between the sidewall and the blow-drying part in the housing and exhausts gas from the inside of the housing to the outside of the housing;

a rectifying member which is disposed between the blow-drying part and the exhaust part in the housing and faces the web being transferred in the transfer direction; and a floating support member which supports the web by injecting gas onto the web outside the sidewall, the web moving between the inside and the outside of the sidewall through the opening in the transfer direction, wherein the floating support member injects gas onto a surface on one side of both sides of the web, and the rectifying member is disposed on another side opposite to the one side of both sides of the web and not disposed on the one side.

10. A web drying method, comprising:

transferring a web in a transfer direction;

injecting gas from two blower units included in a blow-drying part onto the web passing through a dry path between the two blower units; and exhausting gas from the inside to the outside of a housing which has a sidewall provided with an opening facing the dry path from the transfer direction, through which the web passes in the transfer direction through the opening, and houses the blow-drying part, by an exhaust part disposed between the sidewall and the blow-drying part in the housing, wherein a rectifying member disposed between the blow-drying part and the exhaust part in the housing faces the web being transferred in the transfer direction, wherein a floating support member supports the web by injecting gas onto the web outside the sidewall, the web moving between the inside and the outside of the sidewall through the opening in the transfer direction, wherein the floating support member injects gas onto a surface on one side of both sides of the web, and wherein the rectifying member is disposed on another side opposite to the one side of both sides of the web and not disposed on the one side.

* * * * *